United States Patent [19]

Blakeslee

[11] Patent Number: 4,519,892

[45] Date of Patent: May 28, 1985

[54] FIREMEN'S TOOL MOUNTING ASSEMBLY

[75] Inventor: Gerald A. Blakeslee, Milton, Del.

[73] Assignee: Gerald A. Blakeslee, Jr., Milton, Del.

[21] Appl. No.: 609,138

[22] Filed: May 11, 1984

[51] Int. Cl.[3] ..... B65D 69/00; B65D 85/02; B65D 85/20

[52] U.S. Cl. ..... 206/223; 211/70.6; 206/373

[58] Field of Search ..... 206/373, 372, 349, 231, 206/223; 211/70.6; 403/42, 20, 19, 11, 12

[56] References Cited

U.S. PATENT DOCUMENTS 2,344,540 3/1944 Dowd ..... 206/373

4,437,568 3/1984 Hamblin ..... 206/223

*Primary Examiner*—William T. Dixson, Jr.

*Attorney, Agent, or Firm*—B. P. Fishburne, Jr.

[57] ABSTRACT

Several essential tools required by firemen at a fire scene are assembled together to form a unit which is supported in a safe and stable manner by a bracket which may be flush mounted on a vertical surface of a fire engine or may be mounted on a stanchion rising from a running board of the fire engine.

6 Claims, 3 Drawing Figures

FIREMEN'S TOOL MOUNTING ASSEMBLY

BACKGROUND OF THE INVENTION

When arriving at a fire scene, a fireman customarily jumps from the rear of a fire engine adjacent to a hydrant and pulls a length of hose from the rear of the engine, looping it around the base of the hydrant, while the fire engine, upon receiving a signal from the hydrant man, drives away from the hydrant to pull the hose from its storage bed.

Depending upon how the hose is stored in the storage bed of the fire engine, the hydrant man may have at hand a male or female hose coupling or fitting when he jumps from the fire engine.

In any case, the hydrant man removes a cap from the hydrant and opens it for a brief flushing of any foreign matter. Following this, the hydrant man either prepares to connect the hose to the hydrant outlet, or assists in connecting a second pumper to the hydrant as a booster.

He cannot carry out any of the above procedures without the proper tools being immediately at hand. These tools consist of an adjustable hydrant wrench, two hose spanner wrenches, a double male adapter and a double female adapter. These hose adapters are necessary to accommodate the situation where the end of the hose pulled from the fire engine by the hydrant man carries a male or female coupling, the coupling type being unpredictable in advance.

Obviously, the above five essential tools must be easily accessible to the hydrant man if serious delays in connecting the hose to the hydrant are to be avoided. At present, there is no standard or universal method of maintaining the tools together in a convenient, readily accessible and unitized manner. Practice is somewhat varied. Brackets are sometimes provided to support each tool separately, often at different locations on the fire engine. The fireman at the hydrant must quickly collect these tools and deal with an armful of tools when they are separately stored. Occasionally, one tool may be missing from its bracket and located somewhere else on the fire engine, resulting in valuable time being lost while searching for the tool.

In other cases, the tools may be strapped or tied together and attached as a bundle to the hose or simply hung at some random location on the fire engine. This latter procedure can be damaging to the finish of the fire engine.

The present invention has for its objective to provide a complete, convenient and practical solution to the above problems and awkward practices of the prior art. In accordance with the invention, the five essential tools are assembled together as a unit, and the unit is supported or stored at a single location on the fire engine so that it can be picked up conveniently with one hand by the hydrant fireman. Precious time is saved at the fire scene in making the hose hook-up with the hydrant and all fumbling and searching for individual tools, untying ropes or releasing straps from tools is eliminated.

The preassembled tools, as a unit, are placed on a simple mounting bracket at a predetermined fixed location on the fire engine. The mounting bracket contains two vertically spaced upturned support elements which engage the assembled tools at two locations to support them securely while allowing quick access, removal and separation of the tools at the fire scene.

The mounting bracket can be secured to a vertical surface of the fire engine or can be secured to a stanchion mounted on the running board. The results in terms of convenience and security are the same in either case.

Other features and advantages of the invention will become apparent to those skilled in the art during the course of the following detailed description.

DETAILED DESCRIPTION

Figure 1:
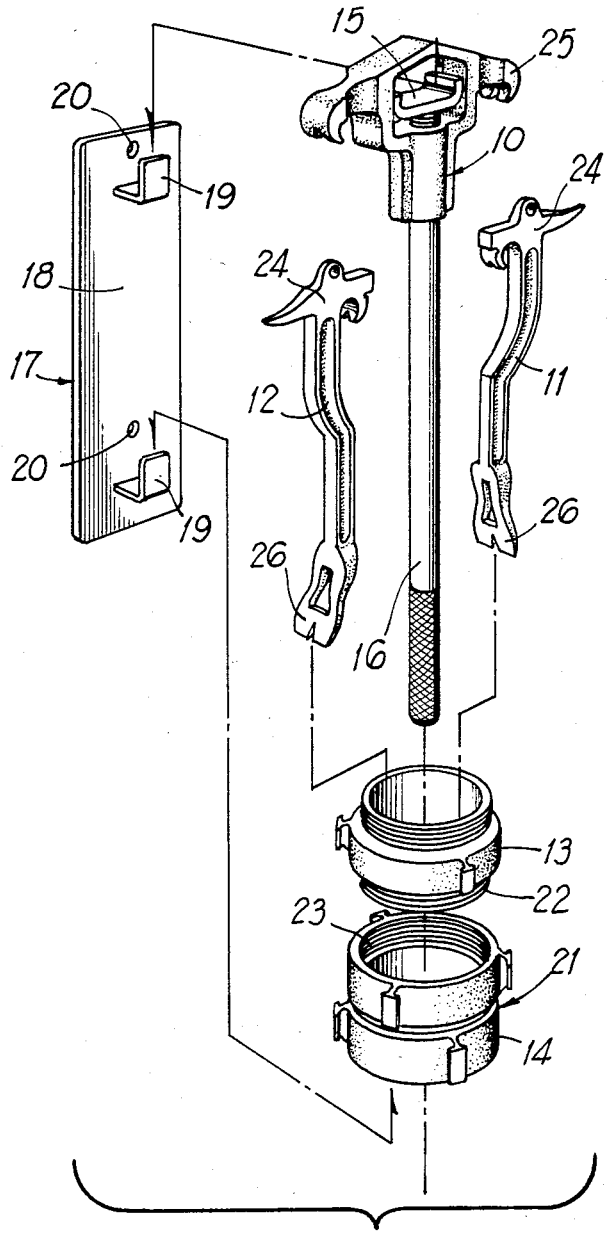
FIG. 1 is an exploded perspective view of a tool assembly and mounting according to the present invention.

Referring to the drawings in detail wherein like numerals designate like parts, essential tools required at a fire scene by the fireman whose duty is to connect a fire hose to a hydrant outlet include an adjustable hydrant wrench 10, two spanner wrenches 11 and 12 for manipulating hose couplings, a double-ended male threaded hose adapter 13, and a double-ended threaded female hose adapter 14. The hydrant wrench 10 includes an adjustable jaw 15 operated by turning the wrench handle 16 on its longitudinal axis. This adjustment allows the hydrant wrench to properly engage the polygonal valve stem of the fire hydrant.

In accordance with this invention, as explained in the introductory portion of the application, the above five essential tools are assembled to form a unit, and the unit is releasably engaged with a simple mounting bracket 17 which can be secured to a running board stanchion, not shown, or may be flush-mounted on a convenient vertical surface of the fire engine, such as a vertical surface immediately above a running board. When the bracket 17 is flush-mounted on such a surface, a suitable scuff plate, not shown, is preferably installed between the bracket 17 and the painted surface of the fire engine to protect the latter from damage by the tools.

The mounting bracket 17 comprises a flat rectangular preferably vertically elongated plate body 18 equipped near its top and bottom ends with a pair of preferably L-shaped supports or hooks 19 rigid with the plate body 18 and each including an upstanding vertical portion rising above the lower horizontal portion which is united with the plate body 18. The plate body 18 is provided with a pair of spaced apertures 20 for the reception of mounting screws.

Figure 2:
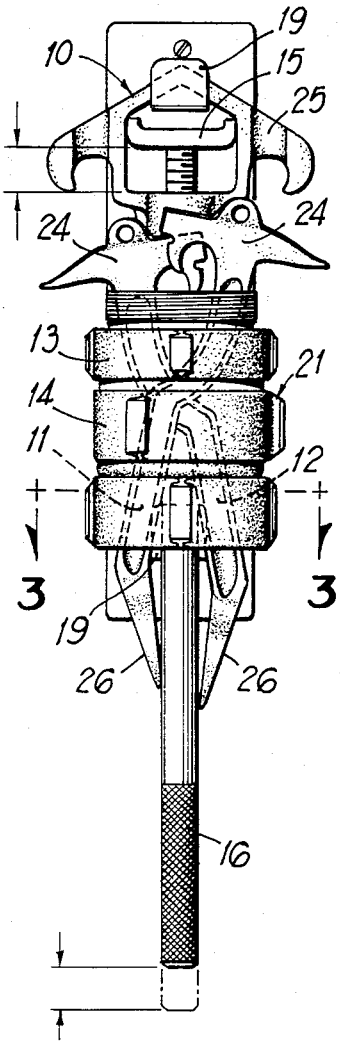
FIG. 2 is an assembled side elevation of the same.

The unitized assembly of the five tool components 10, 11, 12, 13 and 14 shown in FIG. 1 is designated by the numeral 21 in FIG. 2. This unitized assembly is formed by joining the male and female adapters 13 and 14 through their male and female screw-threads 22 and 23 to form an open-ended sleeve. The handle portions of the three wrenches 10, 11 and 12 are placed through the open-ended sleeve composed of the hose adapters 13 and 14 with the heads 24 and 25 of the wrenches disposed above the top of the sleeve whereby they cannot descend through the bore of the sleeve because they are larger than such bore.

Figure 3:
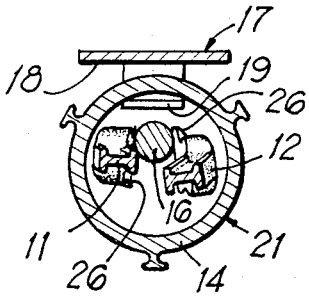
FIG. 3 is a horizontal section taken on line 3—3 of FIG. 2.

As best shown in FIGS. 2 and 3, the handle portions of the two spanner wrenches 11 and 12 are in crossed relationship within the bore of the sleeve with their lower terminals 26 straddling the handle 16 of the hydrant wrench. This compact relationship of parts enables the formation of the unitized tool assembly 21.

With the tool assembly 21 thus created, a fireman with one hand can lift the assembly and place the bottom of the open-ended sleeve over the lower hook 19 while simultaneously engaging the apertured head 25 of the hydrant wrench with the upper hook 19 of the mounting bracket 17. This engagement forms a sturdy and safe two point support for the tool assembly which has proven to be secure in that the assembly will not disengage the mounting bracket 17 until lifted off by a fireman, in spite of normal vibrations encountered during travel.

However, if greater security is desired, the handle 16 of the hydrant wrench can be rotated a few turns to move the jaw 15 upwardly toward the upper support hook 19, thereby making it impossible to lift the tool assembly 21 from the bracket 17 without first moving the jaw 15 downwardly a bit.

Upon arrival at a fire scene, as previously described, the hose hook-up or hydrant man will always find the assembly of the five essential tools at one location on the fire engine in condition to be quickly lifted as a unit from the support bracket 17, ready for use without fumbling and without searching for some tools which might be separated from others in current practice, as previously explained.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A firemen's tool assembly and mounting comprising a vertically disposed stationary mounting bracket having a pair of vertically aligned and spaced upturned support elements, and an assembly of essential firemen's tools bodily supportable on said mounting bracket and being readily liftable therefrom by hand, and said tool assembly comprising a substantially vertical axis sleeve formed by the interconnection of male and female threaded hose adapters, and a plurality of separate wrenches each having handles insertable downwardly through the bore of said sleeve and each having enlarged heads disposed above the upper end of said sleeve and being of sizes whereby said heads cannot pass downwardly through the bore of said sleeve, and the tool assembly being supportively engaged with the mounting bracket by having the lower upturned support element on the mounting bracket engaged upwardly through the bottom of the sleeve and the top upturned support element engaged with the head of one of said wrenches, whereby the tool assembly is supported at two points along its vertical length.

2. A firemen's tool assembly and mounting as defined in claim 1, and the head of one of said wrenches being apertured and extending above the heads of the other wrenches, and the top upturned support element being engaged through the aperture of said apertured wrench head.

3. A firemen's tool assembly and mounting as defined in claim 2, and an adjustable jaw on the wrench having the apertured head operable to vary the size of the aperture of the head and being movable toward and away from the top upturned support element, whereby the apertured head can be locked by said movable jaw against removal from the top upturned support element.

4. A firemen's tool assembly and mounting comprising a stationery mounting bracket having a pair of vertically spaced support elements thereon, and an assembly of essential firemen's tools which is unitized and having a lower mounting surface engageable with the lowermost of said support elements and an upper mounting surface engageable with the uppermost of said support elements, whereby the unitized assembly of tools is hung on said mounting bracket and is liftable therefrom as a unit by hand.

5. A firemen's tool assembly and mounting as defined in claim 4, and adjustable means on said assembly movable toward and away from the uppermost support element of the mounting bracket, whereby the assembly can be releasably locked on the mounting bracket.

6. An assembly and mounting for firemen's essential tools comprising a tool assembly consisting of a sleeve body and plural tools having handle portions insertable through the bore of the sleeve body and having enlarged heads disposed near and beyond one end face of the sleeve body, and a coacting mounting bracket for said tool assembly including a plate body adapted to be fixed in a vertical plane and a pair of vertically spaced support elements projecting from the plate body, the bottom edge of the sleeve body being engageable on the lowermost support element and resting thereon, and a support surface of one of said enlarged heads engaging and resting on the uppermost support element.

* * * * *